United States Patent [19]

Buckley et al.

[11] Patent Number: 4,614,177

[45] Date of Patent: Sep. 30, 1986

[54] MULTI FEATURE RANGE HOOD

[75] Inventors: Norman A. Buckley, Cheektowaga, N.Y.; Roland E. Butt, West Bend; Donald E. Schlegel, Brookfield, both of Wis.

[73] Assignee: Broan Mfg. Co., Inc., Hartford, Wis.

[21] Appl. No.: 606,526

[22] Filed: May 3, 1984

[51] Int. Cl.[4] ..... F24C 15/20

[52] U.S. Cl. ..... 126/299 R; 126/299 D; 312/245; 312/306

[58] Field of Search ..... 126/299 R, 333, 299 d, 126/299 e, 300; 312/246, 245, 247, 306; 98/115.1, 115.3, 115.2

[56] References Cited

U.S. PATENT DOCUMENTS

| | | | |
|---|---|---|---|
| 499,210 | 6/1893 | Canavan | 126/299 D |
| 1,584,707 | 5/1926 | Hedeen | 126/299 R |
| 2,180,459 | 11/1939 | Earle | 126/299 R |
| 2,275,772 | 3/1942 | Koch | 126/299 D |
| 2,535,707 | 12/1950 | Vezey, Jr. | 126/229 D |
| 3,082,680 | 3/1963 | Nevin et al. | 126/299 D |
| 3,251,290 | 5/1966 | Jenson et al. | 126/299 D |
| 3,359,885 | 12/1967 | Faehling | 126/299 D |
| 3,749,465 | 7/1973 | Newcomer | 312/245 |

FOREIGN PATENT DOCUMENTS

| | | | |
|---|---|---|---|
| 2508986 | 9/1976 | Fed. Rep. of Germany | 126/299 R |
| 2659019 | 7/1978 | Fed. Rep. of Germany | 126/299 R |
| 2278413 | 2/1976 | France | 126/299 R |
| 2454852 | 12/1980 | France | 126/299 R |

*Primary Examiner*—James C. Yeung

*Attorney, Agent, or Firm*—Andrus, Sceales, Starke & Sawall

[57] ABSTRACT

A range hood (2) mounted above a kitchen range (4) includes one or more storage shelves (6, 8) in the hood. An adjustable tilt-out front panel (22) is adaptable to include openable doors (24) for accessing the shelves, and is operated by a user between a position flush with adjacent cabinetry (20) or the like, and an extended position increasing the vapor collection area above the range. A gravity operated baffle (30) maintains integrity of the collection area liner by covering the additional collection area when the front panel is in the tilted-out position or any position inbetween. The housing (14) for the hood has an upper portion (16) and a lower depending portion (18) adjustably mounted to the upper portion to provide an adjustable overall vertical height. A hood mounting system provides built-in three dimensional adjustment and allows an installer to restrict adjustments to a single plane at a time for final fine tuning adjustment.

14 Claims, 4 Drawing Figures

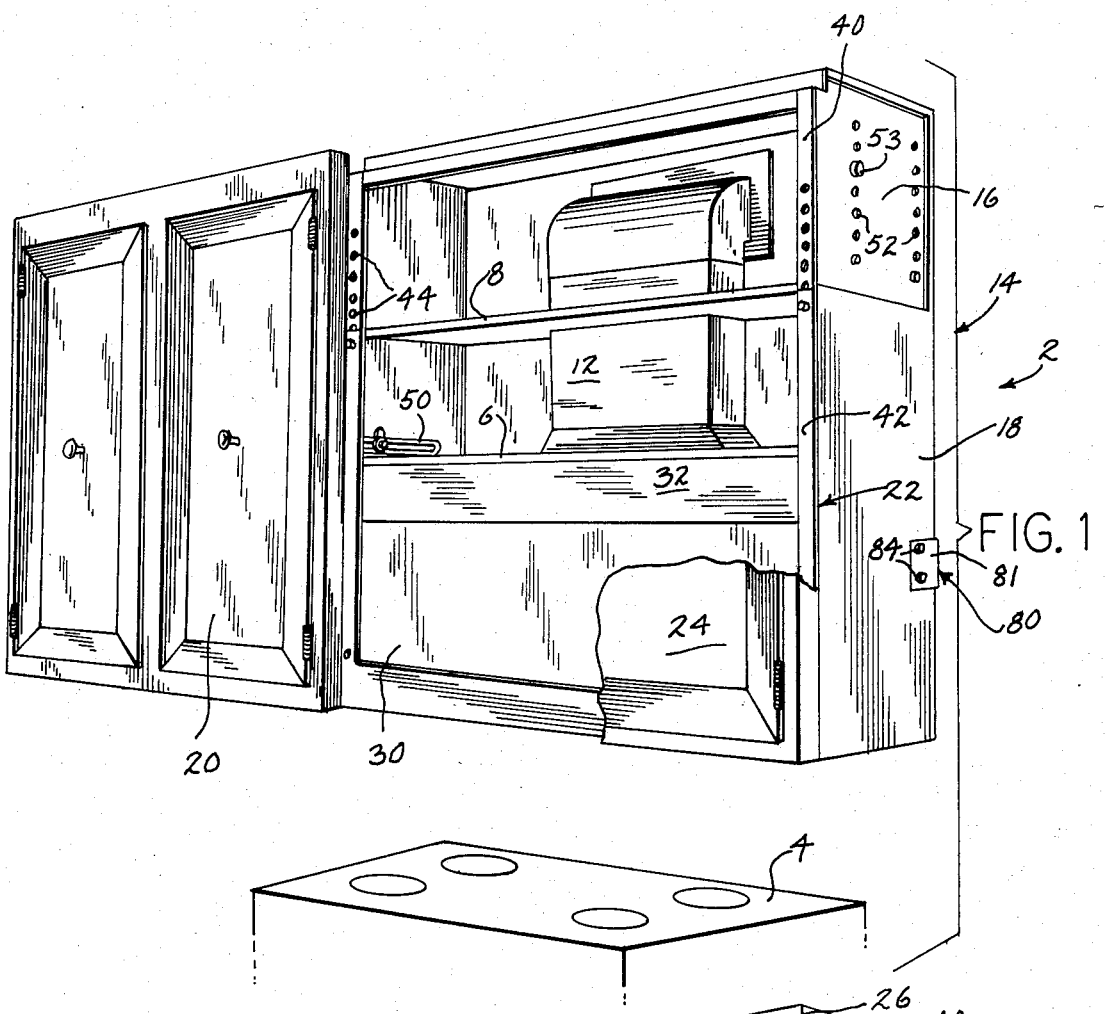
FIG. 1
FIG. 2
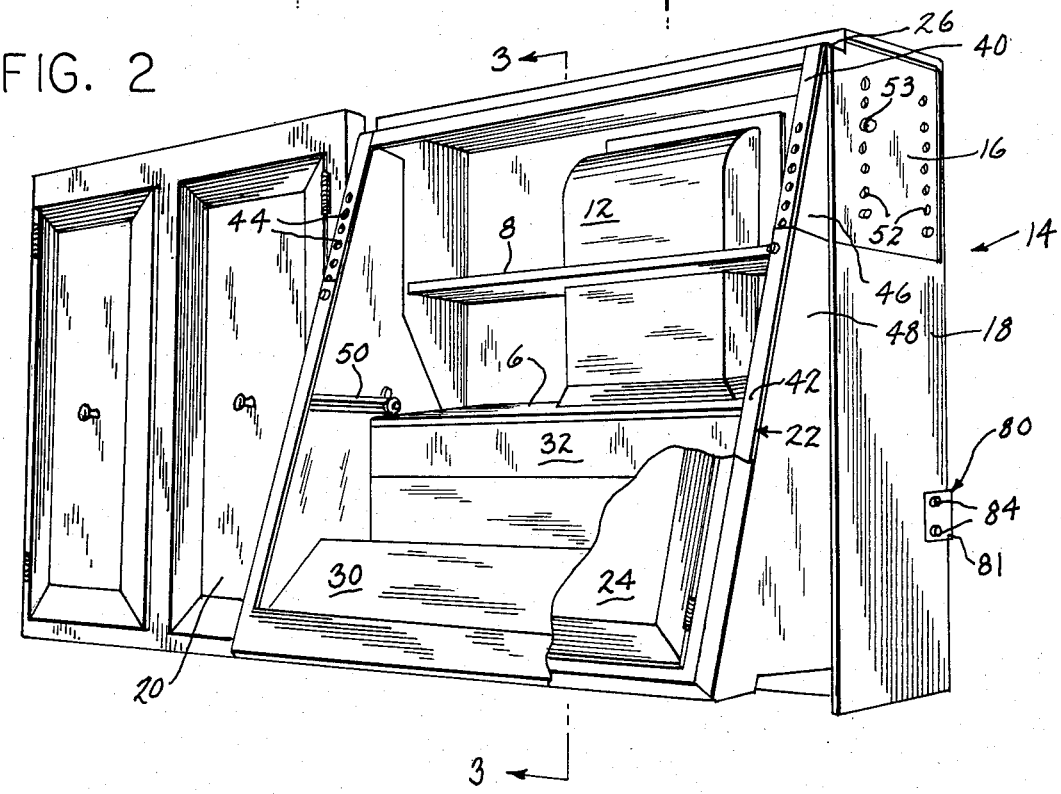

MULTI FEATURE RANGE HOOD

BACKGROUND AND SUMMARY

The invention relates to range hoods mounted above a kitchen range for collecting and exhausting cooking vapors.

The invention provides numerous desirable features. Shelves are provided in the range hood, inside a housing. An adjustable tilt out front panel has an extended tilted-out position increasing the collection area above the range, and a pushed-in closed position flush with adjacent cabinetry or the like. The front panel may have openable cabinet-like doors for accessing the shelving inside the housing.

A gravity operated baffle plate maintains closure of the opening between the tilt out front panel and the housing to thereby cover the additional collection area when the front panel is tilted-out.

A height adjustment system is provided by a housing having an upper portion secured above the range and a lower depending portion adjustably mounted to the upper portion to select the overall vertical length of the hood.

A mounting system with built in adjustment is provided by a mounting bracket for securing the hood to a wall or ceiling or like support with three dimensional adjustment relative thereto. An installation aid is provided in the form of jack screws on the mounting bracket for supporting the hood while final three dimensional adjustments are made, and allowing the installer to restrict adjustments to a single plane at a time.

BRIEF DESCRIPTION OF THE DRAWING

FIG. 1 is an isometric illustration of a range hood constructed in accordance with the invention, showing a pushed-in closed flush position.

FIG. 2 is a view like FIG. 1, showing the extended tilted-out position.

DETAILED DESCRIPTION

Figure 3:
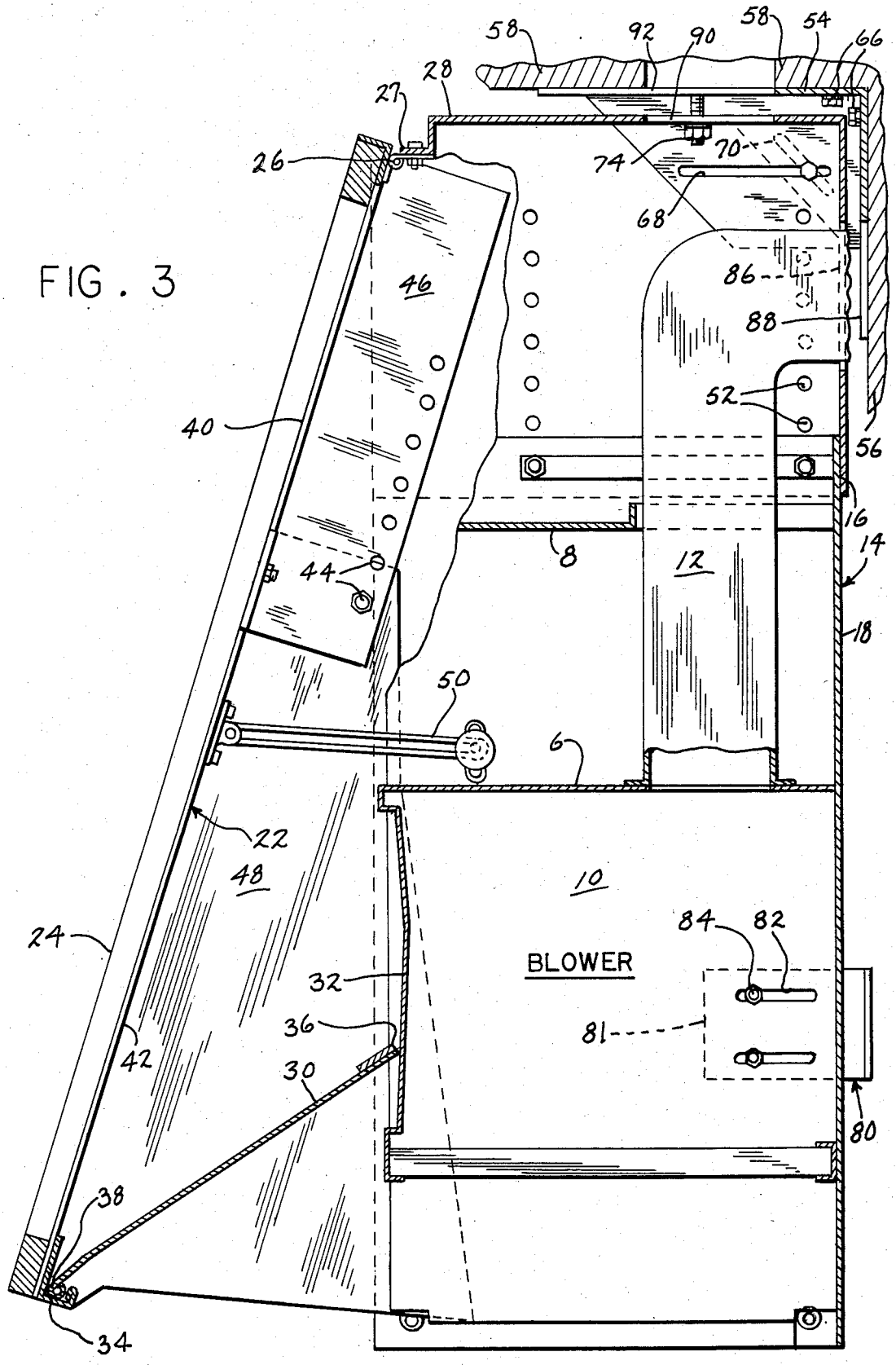
FIG. 3 is a cross sectional view taken along line 3—3 of FIG. 2.

There is shown in FIGS. 1 and 2 a range hood 2 mounted above a kitchen range 4 for collecting and exhausting cooking vapors, and including one or more storage shelves such as 6 and 8 in the range hood. Range hood 2 includes a blower compartment 10, FIG. 3, and exhaust duct work 12 enclosed within a housing 14. Shelves 6 and 8 are inside housing 14. Blower compartment 10 is in the lower portion of the housing, and shelf 6 is the top of the blower compartment, with shelf 8 disposed thereabove. Housing 14 has an upper portion 16 secured above range 4, and a lower depending portion 18 adjustably mounted to upper portion 16 to provide adjustable overall vertical height or length of housing 14. Lower housing portion 18 includes integral shelf 6.

The range hood may be operated by a user between a first position, FIG. 1, substantially flush with adjacent cabinetry 20 or the like, and a second position, FIGS. 2 and 3, having an extending bottom area for collecting cooking vapors. The range hood has a tilt-out front panel 22 having the noted pushed-in flush position, FIG. 1, and having an extended tilted-out position, FIGS. 2 and 3, increasing the collection area above range 4. Front panel 22 may have openable cabinet doors such as 24 thereon for accessing shelves 6 and 8 inside housing 14.

The top of front panel 22 is piano-hinged at 26 to depending front edge 27 of the upper housing portion slightly below top wall 28, to facilitate appropriate clearance. Panel 22 is alternatively hinged at the sides of the upper housing portion. A baffle plate 30 extends between front panel 22 and an intermediate hood portion 32 therebehind and covers the additional collection area when front panel 22 is in the tilted-out position. Baffle plate 30 is gravitationally operated and extends from a lower section 34 of the front panel to front wall 32 of blower compartment 10 to slide along the latter as the front panel is tilted-out. The rear edge 36 of baffle plate 30 slides along the intermediate hood portion formed by the front wall 32 of blower compartment 10. The front edge 38 of baffle plate 30 is stationary relative to front panel 22, and rests in the flange of lower edge 34.

Front panel 22 has an upper portion 40 secured to upper housing portion 16 for tilting away therefrom, as above noted. Front panel 22 has a lower depending portion 42 adjustably mounted to upper front panel portion 40, by means of a series of alignment holes 44, to provide adjustable height of front panel 22 to match the height of housing 14 in the pushed-in flush position, FIG. 1. Upper and lower front panel portions 40 and 42 include rearwardly extending wings 46 and 48 providing side closure in the tilted-out position, FIG. 2. Friction slide 50 holds front panel 22 in any of the progressively tilted-out positions.

Figure 4:
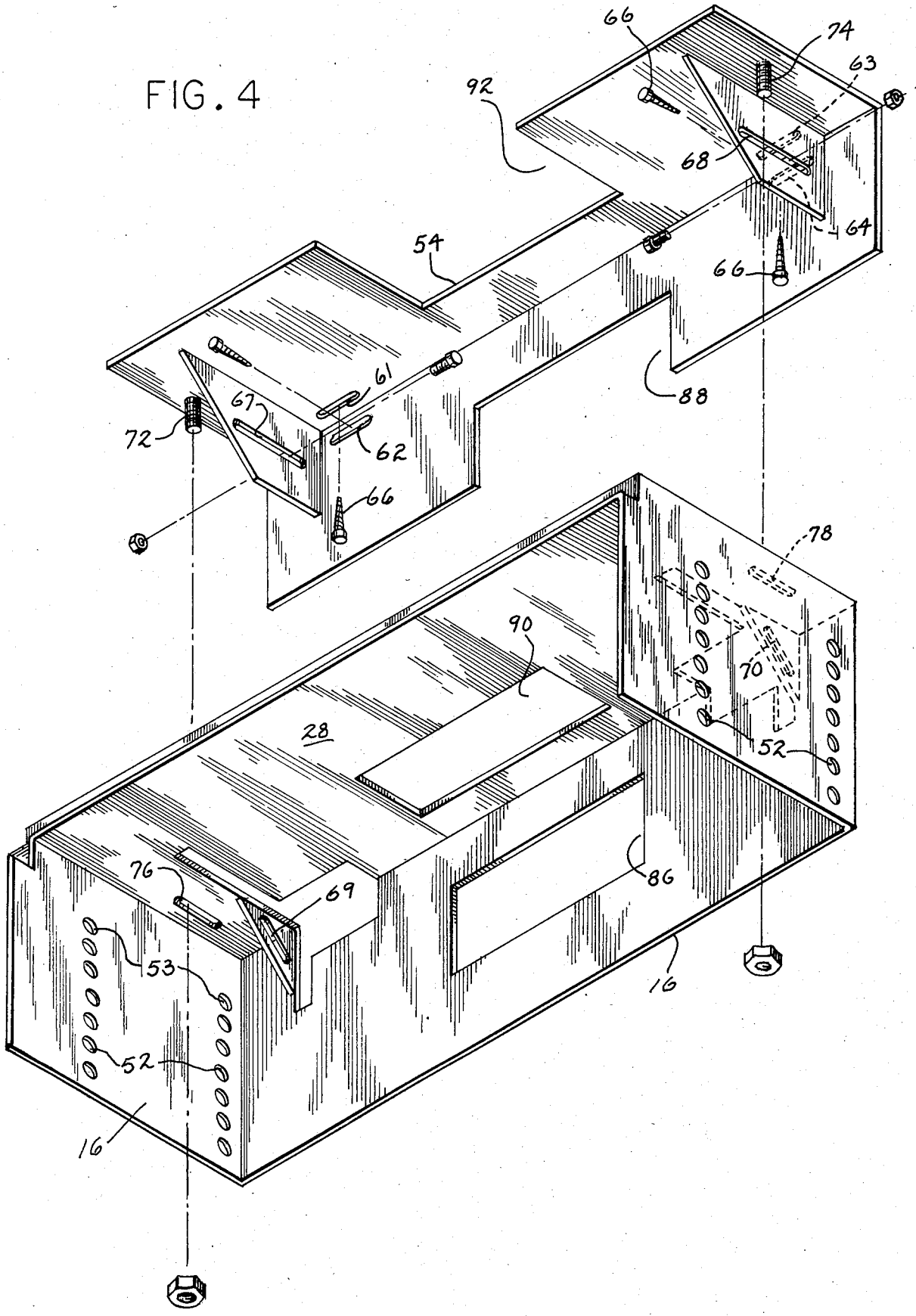
FIG. 4 is an isolated isometric view of the mounting bracket and upper housing portion of FIG. 3.

Prior to installation, the installer determines the desired height or overall vertical length of hood 2 and the desired spacing thereof above range 4. The installer then glides lower housing portion 18 upwardly into upper housing portion 16 until the desired height is achieved, in accordance with alignment means on the upper and lower housing portions, such as a series of alignment holes 52 with bolts such as 53 therethrough providing overall height adjustment. After the upper and lower housing portions are assembled and adjusted for height, housing 14 is mounted by bracket 54, FIG. 4, to a wall 56, FIG. 3, or ceiling 58, or like support, with three-dimensional adjustment relative thereto. Mounting bracket 54 comprises a first set 61–64 of left-right elongated slot means for securing bracket 54 by anchoring screws such as 66 to wall 56 or ceiling 58 or a like support, with left-right adjustment. Bracket 54 includes a second set 67–68 of elongated slot means. A third set 69–70 of elongated slot means is provided on upper housing portion 16 and cooperates with second set 67–68 to mount housing 14 to mounting bracket 54 with up-down and front-back adjustment. The second set of elongated slots 67–68 extends front-back, and the third set 69–70 extends obliquely at an angle front-back and up-down.

A pair of jack screws 72 and 74 on mounting bracket 54 are provided for engaging and supporting upper housing portion 16 at elongated slots 76 and 78 while adjusting the noted dimensions, and allowing an installer to restrict adjustments to a single plane at a time. L-shaped bracket 80 is mounted to the wall and has a forwardly extending leg 81. Elongated slot means such as 82 in either lower housing portion 18 or leg 81 receive bolts such as 84 therebetween, for providing front-back adjustment of the lower portion of housing 14 in conjunction with the above noted adjustments, or providing a tilting out of the lower portion of the housing. Mating openings 86 and 88 are provided in upper housing portion 16 and mounting bracket 54, respectively, for exhaust duct work 12 in wall-exhaust applications. Openings 90 and 92 are provided for ceiling-exhaust applications.

It is recognized that various modifications are possible within the scope of the appended claims.

We claim:

1. A range hood mounted above a kitchen range for collecting and exhausting cooking vapors comprising:

a housing;

a blower compartment in the lower portion of said housing, said blower compartment having associated ductwork for exhausting cooking vapors;

a plurality of storage shelves in said housing, a first of said shelves being the top of said blower compartment, a second of said shelves being disposed thereabove; and a tilt-out front panel hinged at the top of said housing to have an extended tilted-out position increasing the collection area above said range and having a pushed-in flush position, said front panel having openable doors for accessing said storage shelves.

2. The range hood according to claim 1 wherein said housing has an upper portion secured above the range; a lower portion including said blower compartment; and mounting means for adjustably affixing said lower portion on said upper portion in discrete increments of adjustable height to establish the overall vertical height of said housing; said tilt-out front panel having means for correspondingly altering the height of front panel.

3. The range hood according to claim 2 wherein said front panel has an upper portion secured to said upper housing portion for tilting away therefrom, said front panel having a lower depending portion, said front panel having mounting means for adjustably affixing said lower portion on said upper portion in discrete increments of adjustable height for altering the height of said front panel to match the height of said housing when said panel is in said pushed-in flush position.

4. The range hood according to claim 1 including a gravity operated baffle extending from a lower section of said front panel to a front wall of said blower compartment to slide therealong as said front panel is tilted out.

5. The range hood according to claim 4 wherein the rear edge of said baffle slides along said blower compartment front wall and the front edge of said baffle plate is stationary relative to said front panel.

6. The range hood according to claim 1 further including mounting bracket means for securing said hood to a wall, ceiling, or like support with three dimensional adjustment relative thereto, said mounting bracket means comprising a first set of left-right elongated slot means for securing said bracket means to said wall, ceiling, or like support with left-right adjustment, a second set of elongated slot means on said mounting bracket means; and a third set of elongated slot means on said housing cooperating to mount said housing to said mounting bracket means with up-down and front-back adjustment.

7. A range hood mounted above a kitchen range for collecting and exhausting cooking vapors comprising a housing with an upper portion secured above said range; a lower portion including cooking vapor collection means and a blower compartment; a tilt-out front panel hinged at the top of said upper portion of said housing for pivoting between an extended tilted out position increasing the collection area above the range and a pushed in flush position, mounting means for adjustably affixing said lower portion below said upper portion in discrete increments of adjustable height to establish the overall vertical height of said range hood; and adjustment means for correspondingly adjusting the height of said front panel.

8. The range hood according to claim 7 wherein said lower housing portion is incrementally vertically movable along said upper portion to provide said overall height adjustment and front panel is correspondingly incrementally adjustable.

9. The range hood according to claim 8 including mounting bracket means for securing said housing to a wall or ceiling, or like support with three dimensional adjustment relative thereto.

10. The range hood according to claim 9 wherein said mounting bracket means comprises a first set of left-right elongated slot means for securing said mounting bracket means to said wall, ceiling, or like support with left-right adjustment; a second set of elongated slot means on said mounting bracket means; and a third set of elongated slot means on said upper housing portion cooperating to mount said upper housing portion to said mounting bracket means with up-down and front-back adjustment.

11. The range according to claim 10 further comprising lower bracket means secured to said wall and elongated slot means on one of said lower housing portion and lower bracket means for front-back adjustment of said lower housing portion.

12. A range hood mounted above a kitchen range for collecting and exhausting cooking vapors including mounting bracket means for securing said hood to a wall, ceiling, or like support with three dimensional adjustment relative thereto, said mounting bracket means comprising a first set of left-right elongated slot means for securing said mounting bracket means to said wall, ceiling, or like support with left-right adjustment, a second set of elongated slot means on said mounting bracket means; and a third set of elongated slot means on said hood cooperating to mount said hood to said mounting bracket means with up-down and front-back adjustment.

13. The range hood according to claim 12 wherein one of said second and third sets of elongated slot means extends front-back and the other of said second and third sets of elongated slot means extends obliquely at an angle front-back and up-down.

14. The range hood according to claim 12 further including screw jack means on said mounting bracket for engaging and supporting said upper housing portion while adjusting said dimensions and allowing an installer to restrict adjustments to a single plane at a time.

* * * * *